United States Patent [19]

Kinard

[11] Patent Number: 4,739,302

[45] Date of Patent: Apr. 19, 1988

[54] ROAD CONSTRUCTION BARRIER/MARKER

[76] Inventor: Noel S. Kinard, 13423 3rd St., S.E., Ft. Myers, Fla. 33905

[21] Appl. No.: 882,774

[22] Filed: Jul. 7, 1986

[51] Int. Cl.[4] ..... E01F 9/01

[52] U.S. Cl. ..... 340/114 B; 40/608; 116/63 C; 340/114 R; D10/109

[58] Field of Search ..... 340/114 B, 114 R, 107, 340/119, 908; 40/608, 612; 116/63 P, 63 C; D10/109, 111, 113

[56] References Cited

U.S. PATENT DOCUMENTS

| | | | |
|---|---|---|---|
| 1,228,615 | 6/1917 | Stafford | 40/608 |
| 1,439,101 | 12/1922 | Hatcher | 40/608 |
| 2,949,531 | 8/1960 | Lemelson | 340/114 B |
| 3,699,913 | 10/1972 | Sautbine | 116/63 P |
| 4,083,033 | 4/1978 | Kulp et al. | 340/114 R |
| 4,394,843 | 7/1983 | Ediriwira | 116/63 P |

FOREIGN PATENT DOCUMENTS

| | | | |
|---|---|---|---|
| 617495 | 2/1961 | Italy | 116/63 P |

*Primary Examiner*—Joseph A. Orsino
*Assistant Examiner*—Brian R. Tumm
*Attorney, Agent, or Firm*—Charles J. Prescott

[57] ABSTRACT

A combination road construction barrier and marker comprising a generally conically shaped, preferably hollow, upper portion and a generally semispherically shaped base portion. Positioned at the top of the upper portion is a lens-covered light source for nightime operation. The bottom surface of the base portion is flat and is weighted so as to render this invention self-righting in response to strong winds or vehicle impact. One peripheral segment of the generally circular cross section of this invention is flat and extends longitudinally along substantially the entire length of the barrier to prevent excessive rolling in response to external force. The base may include a dry cell battery as one embodiment of a power source to supply electrical power to the preferred electric light source and which is serviceable through a lockable bottom closure. Alternate colored indicia portions may also be applied to the upper portion to improve visibility.

14 Claims, 1 Drawing Sheet

Fig. 2
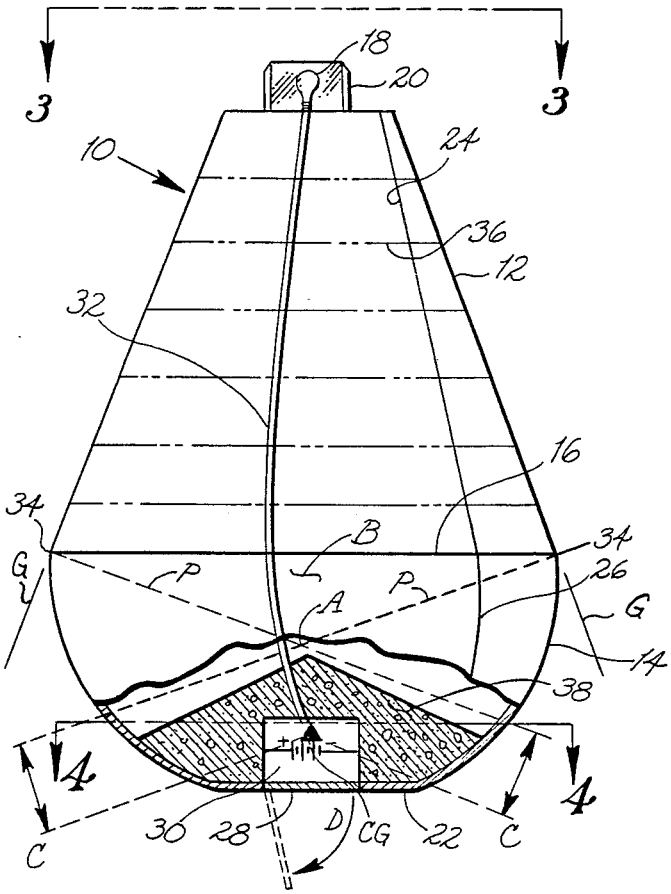
Fig. 1
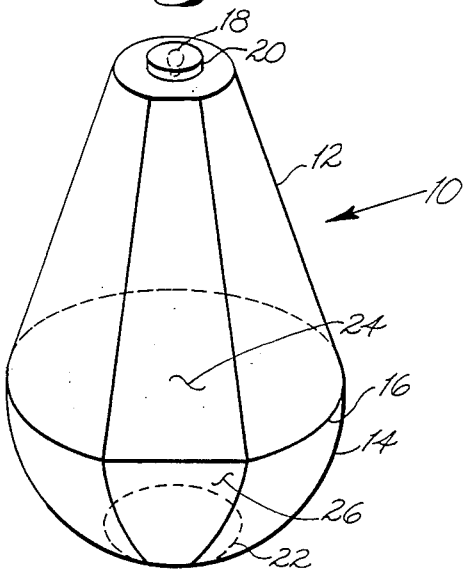
Fig. 4
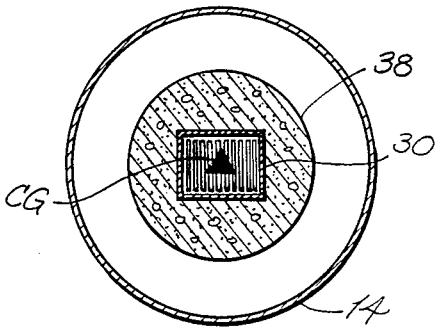
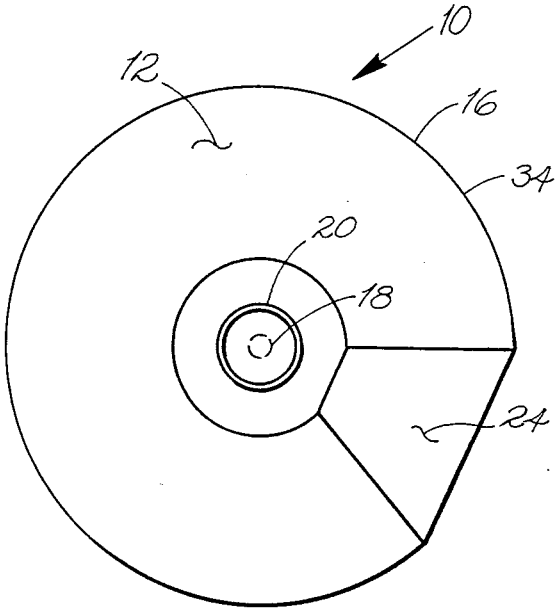
Fig. 3
Fig. 5
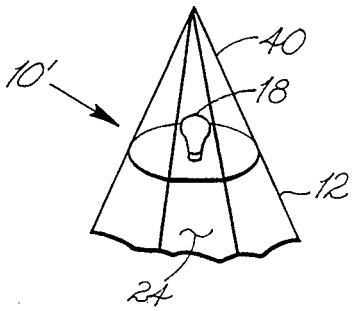

ROAD CONSTRUCTION BARRIER/MARKER

BACKGROUND OF THE INVENTION

This invention relates generally to road construction barriers, and more particularly to an improved combination barrier/marker with improved operating characteristics.

Several well-known structures are available to those in highway and road construction to delineate and render secure areas under construction or repair in a roadway.

One such device is the well-known A-frame or "sawhorse" type structure having alternate indicia and a light source thereon. These devices are foldable for improved storage but are susceptible to damage and being knocked or blown down.

Another such well-known device is the integral hollow molded cone shaped markers having flanged flat bottoms. These devices are lightweight and inexpensive to manufacture, and store conveniently, but do not include a light source and, when struck by a vehicle or blown by strong winds, will easily be displaced and roll in an uncontrolled fashion either under a moving vehicle or away from the area of usefulness.

The present invention provides a combination barrier/marker which includes a light source at its upper portion, for improved daytime and nighttime visibility, and unique structure rendering this invention self-righting and non-rollable to also prevent it from being substantially displaced from at the area of usefulness by vehicle impact or extreme winds. The lower weighted portion, which may include a power source for the upper light, also provides sufficient mass so that this invention may serve, not only as a marker, but also as a light duty barrier.

BRIEF DESCRIPTION OF THE INVENTION

This invention is directed to a combination road construction barrier and marker comprising a generally conically shaped, preferably hollow, upper portion and a generally semispherically shaped base portion. Positioned at the top of the upper portion is a lens-covered light source for nightime operation. The bottom surface of the base portion is flat and is weighted so as to render this invention self-righting in response to strong winds or vehicle impact. One segment of the generally circular cross section of this invention is flat and extends longitudinally along substantially the entire length of that peripheral portion of the barrier to prevent excessive rolling in response to external forces such as vehicle impact and high winds. The base may include a dry cell battery as one embodiment of a power source to supply electrical power to the preferred electric light source and which is serviceable through a lockable bottom closure. Alternate colored indicia portions may also be applied to the upper portion to improve visibility.

It is therefore an object of this invention to provide an improved combination barrier and marker which is self-righting in response to high winds and vehicle impact.

It is another object of this invention to provide a combination barrier and marker which will not roll a substantial distance from the area of use in response to external force.

It is another object of this invention to provide a combination barrier and marker with a lighted upper portion and visible indicia thereon for improved visibility.

It is another object of this invention to provide a combination barrier and marker with a light source and built in power source for that light.

In accordance with these and other objects which will become apparent hereinafter, the instant invention will now be described with reference to the accompanying drawings in which:

BRIEF DESCRIPTION OF THE DRAWINGS

FIG. 1 is a perspective view of a simplified representation of the invention.

FIG. 2 is a side elevation view in partial section of the invention.

FIG. 3 is a top plan view of the invention in the direction of arrows 3—3 in FIG. 2.

FIG. 4 is a section view in the direction of arrows 4—4 in FIG. 2.

FIG. 5 is a perspective view of an alternate embodiment of the upper portion of the invention.

DETAILED DESCRIPTION OF THE INVENTION

Referring now to the drawings and particularly to FIGS. 1, 2 and 3, the invention is shown generally at numeral 10 and includes a generally conical shaped upper portion 12 and a generally semispherically shaped base portion 14 integrally connected along junction plane 16. Connected at the top of upper portion 16 is transparent lens 20 which houses and protects light source 18. Preferably, light source 18 is an electric lightbulb powered by d.c. current and voltage.

The bottom 22 of base 14 is flat and provides a stable surface which is intended to contact and rest upon the ground or road surface. Extending substantially the entire length of the barrier/marker 10 is a two part flat segment 24 and 26. The upper side flat 24 is planar and extends along the entire length of conically shaped upper portion 12. The elliptically contoured base side flat 26 is a continuation of upper side flat 24 extending from the junction plane 16 downwardly to the bottom flat 22. These upper side and base side flats 24 and 22 combine and serve to prevent the barrier/marker 10 from rolling along the ground in response to excessive winds or vehicle impact which tip the invention 10 off of its bottom flat 22 and onto its side.

This invention 10 is rendered generally self-righting by the weighted portion or ballast 38 which is rigidly secured in the lower part of base portion 14. In combination with the dry cell battery 30 which provides d.c. current to light source 18 via electrical interconnection means 32, the ballast 38 produces a certain value and positioning of a center of gravity CG. This center of gravity CG is positioned below the apex A of the imaginary cone B created by the projected surface P extending inwardly and perpendicularly from the bottom perimeter 34 of conical upper portion 12. By this positioning of the center of gravity CG, should the barrier/marker 10 be impacted or blown onto its side so as to momentarily lay against the ground G as symbolically shown extended along the periphery of the upper portion 12, the barrier/marker 10 will immediately self-right itself to a stable upright position wherein bottom flat 22 is again resting atop the ground or road surface. This is so because the center of gravity is positioned a distance C below the projected surfaces P and thusly functions in well-known physical terms.

Dry cell battery 30 is held within a mating cavity in ballast 38 by closure 28. By this means, by opening of the closure 28 in the direction of arrow D, dry cell battery 30 may be conveniently serviced and replaced when required and resecured in place. The closure 28 may also be made water tight when secured in its closed position.

Daytime visibility of the barrier/marker may be enhanced by horizontally disposed adjacent bands of indicia indicated by lines 36 on the upper portion of invention 10.

Referring to FIG. 4, the preferred embodiment of ballast 38 is shown, in conjunction with FIG. 2, having a conically shaped upper portion. Ballast 38 is preferably cast formed of concrete or the like but may also be constructed of enclosed lead or steel shot or pellets. However, other alternate cast formed or rigidly connected weight material may be suitably installed and having other convenient upper surface shapes.

Referring to FIG. 5, an alternate embodiment 10' of the invention is shown having a continuous generally conical top portion formed by transparent lens 40 and offering alternate aesthetics and improved light source 18 protection, as well as simplicity in manufacture.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A combination road construction barrier and marker comprising:

a generally conically shaped upper portion and a generally semispherically shaped base portion connected at the lower end of said upper portion;

said base portion having a flat bottom surface for resting said barrier atop the ground;

the top of said conical upper portion including a light source housed within a transparent protective housing;

said upper and base portions having a longitudinally disposed side flat segment disposed along a portion of the peripheral surfaces of said upper and base portions;

said base portions having ballast means housed therein adapted to render said barrier self-righting to the upright position wherein said flat bottom surface is atop the ground;

said side flat segment shaped to prevent rolling of said barrier along the ground when subjected to external force.

2. A combination road construction barrier and marker as set forth in claim 1, further comprising:

a power source mounted within said base portion for energizing said light source;

said power source also for contributing to said ballast means.

3. A combination road construction barrier and marker as set forth in claim 2, wherein:

said upper portion includes a plurality of horizontally disposed adjacent bands of indicia to enhance visibility of said barrier.

4. A combination road construction barrier and marker as set forth in claim 2, wherein:

said power source is a dry cell battery for providing d.c. voltage to said light source;

said base portion including said dry cell battery also including a releasably lockable closure means for covering and facilitating replacement of said dry cell battery.

5. A combination road construction barrier and marker as set forth in claim 4, wherein:

said upper portion is a molded hollow shell.

6. A combination road construction barrier and marker as set forth in claim 1, wherein:

said ballast means is cast formed concrete.

7. A road construction marker comprising:

an integrally molded body having a generally conical upper portion and a generally semispherical base portion;

said base portion having a flat exterior bottom surface;

said upper portion having a transparent top lens means for housing a source of light mounted therein;

said base portion having ballast disposed and secured therein;

said ballast sized and positioned in said base portion such that the center of gravity of said barrier is disposed below the apex of an inverted imaginary cone formed by inwardly projecting perpendicularly from the intersection between said upper and base portion; and a longitudinally disposed flattened peripheral portion extending along substantially the length of said barrier for preventing excessive rolling of said barrier along the ground when disturbed by external force.

8. A road construction marker as set forth in claim 7, wherein:

said upper portion is hollow.

9. A road construction marker as set forth in claim 8, wherein:

said integrally molded body is a plastic shell.

10. A road construction marker as set forth in claim 9, wherein:

said ballast is cast concrete.

11. A road construction marker as set forth in claim 7, further comprising:

a power source mounted within said base portion for energizing said source of light;

said power source also for contributing to said ballast.

12. A road construction marker as set forth in claim 11, wherein:

said upper portion includes a plurality of horizontally disposed adjacent bands of indicia to enhance visibility of said barrier.

13. A road construction marker as set forth in claim 11, wherein:

said power source is a dry cell battery for providing d.c. voltage to said light source;

said base portion including said dry cell battery also including a releasably lockable closure means for covering and facilitating replacement of said dry cell battery.

14. A road construction marker as set forth in claim 13, wherein:

said upper portion is a molded hollow shell.

* * * * *